US009493176B2

(12) United States Patent
Busse et al.

(10) Patent No.: US 9,493,176 B2
(45) Date of Patent: Nov. 15, 2016

(54) METHOD FOR OPERATING A RAILWAY SAFETY SYSTEM, AND RAILWAY SAFETY SYSTEM

(75) Inventors: Robert Busse, Schönwalde (DE); Thomas Kohlmeyer, Kirchhorst (DE); Christoph Kutschera, Bad Harzburg (DE); Dominik Lüthe, Salzgitter (DE); Jens-Harro Oechsner, Denkte OT Neindorf (DE); Thomas Schmidt, Braunschweig (DE); Michael Schulze, Berlin (DE); Wolfgang Windolf, Schwülper (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 222 days.

(21) Appl. No.: 14/232,683

(22) PCT Filed: Jun. 25, 2012

(86) PCT No.: PCT/EP2012/062195

§ 371 (c)(1),
(2), (4) Date: Feb. 21, 2014

(87) PCT Pub. No.: WO2013/007501

PCT Pub. Date: Jan. 17, 2013

(65) Prior Publication Data

US 2014/0191090 A1 Jul. 10, 2014

(30) Foreign Application Priority Data

Jul. 14, 2011 (DE) ..... 10 2011 079 186

(51) Int. Cl.
*B61L 29/28* (2006.01)
*B61L 29/32* (2006.01)
*B61L 29/30* (2006.01)

(52) U.S. Cl.
CPC ..... *B61L 29/28* (2013.01); *B61L 29/284* (2013.01); *B61L 29/30* (2013.01); *B61L 29/32* (2013.01)

(58) Field of Classification Search
CPC ..... B61L 29/28; B61L 29/30; B61L 29/284; B61L 29/32
See application file for complete search history.

(56) References Cited

U.S. PATENT DOCUMENTS 4,256,278 A * 3/1981 Sanville ..... B61K 9/06 246/169 D
6,179,252 B1 * 1/2001 Roop ..... B61L 29/18 246/122 R (Continued)

FOREIGN PATENT DOCUMENTS

DE 102008033712 A1 1/2010
DE 102009009449 A1 8/2010

(Continued)

OTHER PUBLICATIONS

Venglar, Steven P., et al. Guide for traffic signal preemption near railroad grade crossing. No. FHWA/TX-01/1439-9,. 2000.*

(Continued)

*Primary Examiner* — John Q Nguyen
*Assistant Examiner* — Alan D Hutchinson
(74) *Attorney, Agent, or Firm* — Laurence Greenberg; Werner Stemer; Ralph Locher

(57) ABSTRACT

A method operates a railway safety system having at least one trackside device while taking into account a measured velocity value recorded when the rail vehicle drives into a switch-on section of the railway safety system. In order to minimize the closing times for a level crossing by such a method, the measured velocity value is used as the basis for checking whether a correction time for forwarding a signal from the one trackside device to an associated railway safety assembly is to be set according to the measured velocity value when the rail vehicle drives into the switch-on section. Thereafter, a set correction time is checked to determine if the set correction time should remain effective according to at least one further influencing variable of the rail vehicle that determines the travel time. A railway safety system for carrying out the method is also provided.

34 Claims, 2 Drawing Sheets

(56) References Cited

U.S. PATENT DOCUMENTS

| | | | | |
|---|---|---|---|---|
| 7,575,202 | B2 * | 8/2009 | Sharkey | B61L 29/32 246/111 |
| 8,157,219 | B2 * | 4/2012 | Ashraf | B61L 29/28 246/130 |
| 8,469,319 | B2 | 6/2013 | Kiss, Jr. et al. | |
| 8,540,192 | B2 | 9/2013 | Basso et al. | |
| 8,870,126 | B2 | 10/2014 | Bock et al. | |
| 2007/0124332 | A1 | 5/2007 | Ballesty et al. | |

FOREIGN PATENT DOCUMENTS

| | | | |
|---|---|---|---|
| DE | 102009019302 | A1 | 10/2010 |
| EP | 1946990 | A2 | 7/2008 |
| JP | 0357769 | | 3/1991 |
| WO | 2009100292 | A1 | 8/2009 |
| WO | 2010006926 | A1 | 1/2010 |

OTHER PUBLICATIONS

Wikipedia, IEEE 802.15.4, printed Oct. 19, 2015.*

Wikipedia, Rail speed limits in the United States, printed Oct. 19, 2015.*

Hartwig, A., et al., "Solar-Anrückmelder über Funk", Signal + Draht, 1+2/2008, pp. 36-39.

Henning, S., et al., "Einschaltpunkte von Bahnübergängen im FFB-Konzept", Signal + Draht, Jan. 1998, pp. 20-23, vol. 90, No. 1-2, Telzlaff Verlag GmbH, Darmstadt, Germany.

Kuhla, E., "Lösungen zur Fahrzeugidentifizierung bei der Bahn", Zeitschrift für Eisenbahnwesen und Verkehrstechnik, Die Eisenbahntechnik + Glasers Annalen, Aug. 1996, pp. 335-340, vol. 120, No. 8, Georg Siemens Verlagsbuchhandlung, Berlin, Germany.

* cited by examiner

METHOD FOR OPERATING A RAILWAY SAFETY SYSTEM, AND RAILWAY SAFETY SYSTEM

BACKGROUND OF THE INVENTION

Field of the Invention

The invention relates to a method for operating a railway safety system having at least one trackside device while taking into account a measured velocity value recorded when the rail vehicle drives into the switch-on section of the railway safety system.

Such a method is described in an article in the journal "Signal+Draht" (100) 1+2/2008, pages 36 to 39. In this known method a rail-mounted sensory trackside device in the form of a solar-powered train approach annunciator is used, which is provided with a transmitter, because it is connected via radio to a trackside device in the form of a central train approach annunciator. With the known approach annunciator, the time at which the rail vehicle drives into the switch-on section of the railway safety system is recorded and reported via radio to the central train approach annunciator, which then activates a railway safety system in the form of a level crossing safety device. The known method is also suitable for recording the velocity of the rail vehicle by means of the approach annunciator and for taking it into account when calculating the approach time of the rail vehicle to the railway safety system.

BRIEF SUMMARY OF THE INVENTION

The object of the invention is to propose a method for operating a railway safety system which can be used to determine the approach time of a rail vehicle to the one trackside device or one railway safety system with a high degree of accuracy.

In order to achieve this object, in a method of the type described at the start, according to the invention a velocity value measured when the rail vehicle drives into the switch-on section is used as the basis for checking whether a correction time for forwarding a signal from the one trackside device to an associated railway safety system is to be set according to the measured velocity value, and thereafter a set correction time is checked to determine whether the set correction time should remain effective as a function of at least one further influencing variable of the rail vehicle that determines the travel time.

A significant advantage of the inventive method consists in the fact that not only does it take into account the velocity when the rail vehicle drives into the switch-on section for the forwarding of a signal from the one trackside device to the associated railway safety system, in order accordingly to reduce the maximum time initially predefined for issuing the signal when the rail vehicle drives into the switch-on section, but also in that a correction time set according to the measured velocity value is checked to determine whether the set correction time should remain effective as a function of at least one further influencing variable of the rail vehicle that determines the travel time. This makes it possible to predict, with a particularly high degree of accuracy, the time at which the rail vehicle will approach the railway safety system or the trackside device; precisely timed activations, reversals and supervision operations can then be carried out accordingly.

Various further influencing variables of the respective rail vehicle may be used in the inventive method. It is considered advantageous if the further influencing variable is a recorded number of axles of the rail vehicle and/or a recorded distance between axles of the rail vehicle and/or a recorded length of the rail vehicle.

It further appears advantageous if the rail vehicle type is determined on the basis of the measured velocity value and the at least one further influencing variable, and if the determined type is used as a decision criterion for checking whether a set correction time is to remain effective. In this case it is particularly advantageous if the number of axles and/or distance between axles and/or train length are used as further influencing variables for determining the rail vehicle type. This is because these influencing variables are particularly significant for the different types of rail vehicle.

It is therefore possible, according to the invention, advantageously to conclude that the train is a passenger train if the number of axles is low.

If the measured velocity value is comparatively low, the set correction time is deleted or reduced in the case of a passenger train.

If the number of axles is high, the conclusion is that the train is a freight train. In this case it is advantageous if, where the measured velocity value is comparatively low, the set correction time is retained or extended in the case of a freight train.

If the measured velocity value of the rail vehicle is comparatively high, the inventive method operates in such a way that the check causes the signal to be output immediately.

In order to output the signal to the railway safety system at an optimum time, it is considered advantageous if the acceleration of the rail vehicle when it drives into the switch-on section is recorded in order to obtain a further influencing variable that determines the travel time and is taken into account in the setting and checking of the correction time.

In the same direction, an embodiment of the inventive method in which the measured velocity value and the further influencing variable 'acceleration' are determined repeatedly when the rail vehicle drives into the switch-on section, has a positive effect.

The approach time of the rail vehicle can be determined with particular accuracy if the measured velocity values and the further influencing variables are continuously determined.

The velocity of the rail vehicle and its acceleration may be determined in different ways. It appears advantageous, if the rail vehicle is appropriately equipped, for the velocity and the acceleration of the rail vehicle to be recorded by means of a global positioning device or an odometer arrangement with connected radio arrangement. A GPS (Global Positioning System) device is advantageously used as the global positioning device.

In this connection it is considered advantageous if a radio arrangement is used that corresponds to the GSM-R (Global Positioning System-Railway) standard or operates with the transmission protocol as per the IEEE 802.15.4 standard.

In order to configure the inventive method so that it works particularly accurately, it is advantageous to take into account parameter data specific to rail vehicles as further influencing variables that determine the travel time. Parameter data that may be considered as being specific to the type of rail vehicle includes, in particular, the maximum speed specific to the rail vehicle type and/or the acceleration capability specific to the rail vehicle type and/or the motive force of the rail vehicle. This makes it possible to predict, with a particularly high degree of accuracy, the time at which the rail vehicle will approach the railway safety system or the one trackside device; precisely timed activations, reversals and supervision operations can then be carried out accordingly. The parameter data specific to the rail vehicle type is normally available on the on-board computer of the rail vehicle, an input interface or a radio module. It is preferably taken from the on-board computer.

In a rail vehicle with an ETCS (European Train Control System) on-board computer, further parameter data specific to the rail vehicle type available there may be used.

It may however also be advantageous—for example if the rail vehicle does not have a GPS device—if the measured velocity value and the further influencing variables of the rail vehicle are recorded by means of a further trackside device provided on the drive-in end of the switch-on section. A wheel sensor with radio device is preferably used as the further trackside device. A wheel sensor as described in unexamined German application DE 10 2009 009 449 A1 is particularly suitable as the wheel sensor.

It is further considered advantageous if an approach annunciator arranged beside the track with the radio device is used as the further trackside device and a central train approach annunciator is used as the trackside device.

The radio device of the further trackside device may be of a different design. It appears advantageous to use as the radio device a radio device with a receiver for receiving parameter data specific to the rail vehicle type of the rail vehicle driving past, and a transmitter for transmitting the measured velocity value and the further influencing variables to the trackside device.

In a further advantageous embodiment of the inventive method the measured velocity value and the further influencing variable 'acceleration' are recorded and transferred to the trackside device by means of the additional trackside devices with radio module arranged along the track on the switch-on section of the railway safety system. Radio routers are advantageously used in the further trackside devices.

Radio routers with a receiver are advantageously used for the parameter data specific to the rail vehicle type.

It is further considered advantageous if, upon receipt of the measured velocity values and the transferred, further influencing variables recorded and transferred to the trackside device when the rail vehicle drives into the switch-on section and travels through the switch-on section, the correction time is calculated by weighting the individual variables and a timer is set accordingly.

A counter is advantageously used as the timer, after expiration of which the signal is output to the railway safety system. Both a backward running counter and a forward running counter set to a specific value may be used for this purpose.

The invention further relates to a railway safety system having at least one trackside device and addresses the object of configuring such a system so that its timing operates with maximum accuracy.

In order to achieve this object, on the basis of a railway safety system having a trackside device on a drive-out end of a switch-on section of the railway safety system and a further trackside device on the drive-in end of the switch-on section, the further trackside device being equipped for recording a measured velocity value when the rail vehicle drives into the switch-on section, according to the invention the trackside device has a train recognition device which has inputs for recording the measured velocity value and further influencing variables that determine the travel time; an adjustable timer is subordinated to the train detection device, and the trackside device which outputs a signal to an associated railway safety system is connected to the timer.

In this way the advantages already explained above in connection with the descriptions of the inventive method can likewise be achieved.

The timer is advantageously an electronic counter which may be designed both as a backward-running and as a forward-running counter.

The further trackside device may be of a different design in the inventive railway safety system; it is considered advantageous if the further trackside device is a wheel sensor with radio device.

It may however also be advantageous if the further trackside device is an approach annunciator arranged beside the track with the radio device and the trackside device is a central train approach annunciator. In this way a railway safety system is created for a level crossing which need only be closed as briefly as possible for road traffic when a rail vehicle approaches.

In the inventive railway safety system, the radio device is advantageously designed such that it can be used to transfer the recorded measured velocity values and further influencing variables wirelessly to the trackside device.

In this connection it is considered advantageous if the radio device is designed such that further influencing variables showing parameter data specific to the rail vehicle type of the vehicle driving past can be recorded.

The radio device may advantageously be provided with a receiver for receiving the parameter data specific to the rail vehicle type of the rail vehicle driving past and with a transmitter for transmitting the measured velocity values and the further influencing variables recorded by the further trackside device to the trackside device.

In order to lend the railway safety system a relatively high degree of accuracy regarding the determination of the approach time of the rail vehicle to the one trackside device, additional trackside devices with radio routers, from which additional measured velocity values are transferred to the trackside device, are arranged along the track in the drive-in section.

DESCRIPTION OF THE INVENTION

Figure 1:
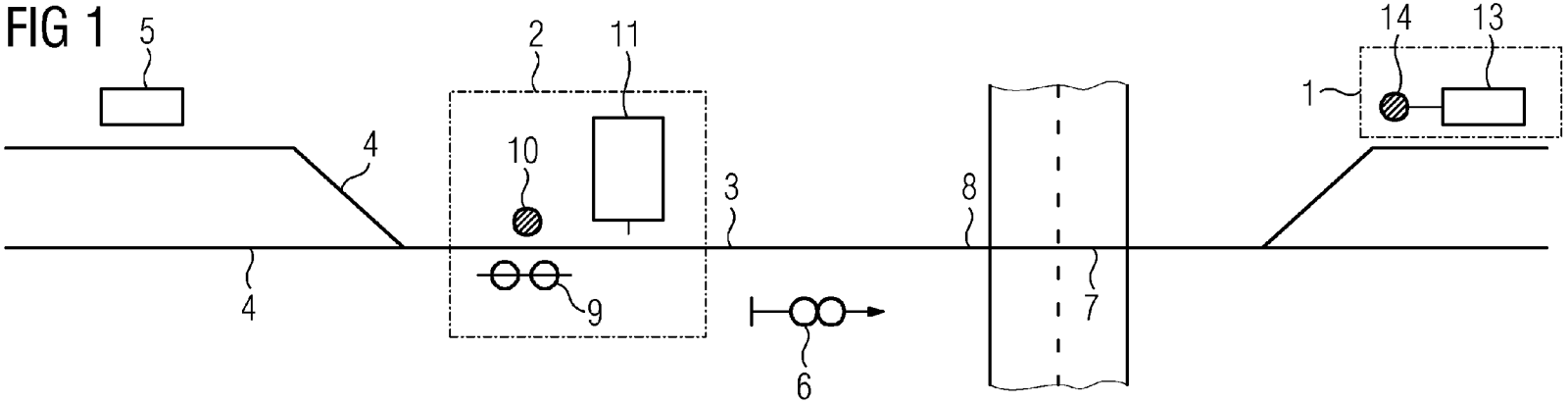
FIG. 1 schematically illustrates an exemplary embodiment of the inventive railway safety system.

The railway safety system according to FIG. 1 has a trackside device 1 and a further trackside device 2.

The further trackside device 2 is arranged on a track 3, to which two further tracks 4 lead in the illustrated exemplary embodiment, to which tracks a signal box 5 is assigned. A so-called entry signal 6 for a switch-on section 8 of the railway safety system situated before a level crossing 7 is also located on the track 3.

The further trackside device 2 has an approach annunciator 9 in the form of a wheel sensor which may be designed as described in the unexamined German application DE 10 2009 009 449 A1. A radio device 10 is also arranged in the further trackside device 2. This radio device 10 contains a receiver (not shown) and a transmitter (likewise not shown). The further trackside device 2 may additionally be equipped with a device 11 for supplying power, which may be designed for example as a solar collector or as an outdoor voltage transformer connected to the overhead cable. Power may also be supplied via cables from the signal box 5.

According to FIG. 1 the one trackside device 1 has a further signal box 13 and a further radio device 14. A component of the trackside device 1 is a central train approach annunciator described in greater detail below.

Figure 2:
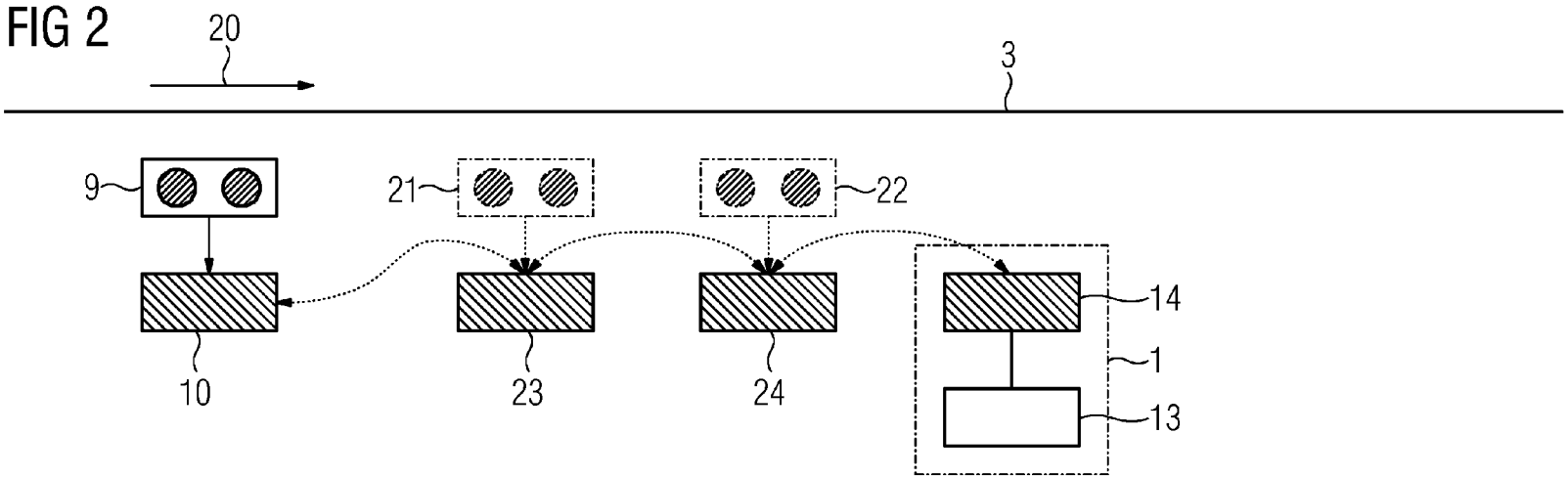
FIG. 2 is a block diagram showing an embodiment with radio routers.

The block diagram shown in FIG. 2, in which elements corresponding to FIG. 1 are provided with the same reference characters, serves to explain further the operation of the railway safety system according to FIG. 1 and/or the inventive method.

When a rail vehicle indicated by an arrow 20 in FIG. 2 travels over the approach annunciator 9, then measurement data which is suitable for deciding the direction of travel is transferred to the radio device 10. This is because it is important to determine whether the rail vehicle is moving toward the level crossing 7 or away from it. In the latter case the railway safety system does not need to be activated in terms of protecting the level crossing 7. The travel velocity of the rail vehicle at the site of the approach annunciator 9 is additionally determined by means of the approach annunciator 9 in the form of a measured velocity value and is transferred to the radio device 10. The acceleration of the rail vehicle at the site of the approach annunciator 9 is also determined with this detector and forwarded to the radio device 10 as a further influencing variable that determines the travel time.

Of particular importance is the fact that the radio device 10 in the illustrated railway safety system is able, by means of its receiver (not shown), to record parameter data specific to the rail vehicle type of the rail vehicle driving past as a further influencing variable of the rail vehicle that determines the travel time. This parameter data specific to the rail vehicle type may for example be the maximum speed and the acceleration capability as well as the motive force of the rail vehicle. This parameter data specific to the rail vehicle type is sent from the rail vehicle driving past or its radio module which operates according to a standardized protocol provided this as is normally the case has an on board computer or another interface. The parameter data specific to the rail vehicle type is transferred wirelessly to the radio device 10 of the further trackside device 2.

The transmitter of the radio device 10 sends the measured velocity value and the further influencing variables that determine travel time as independent data packets wirelessly in a telegram to the radio device 14 of the one trackside device 1. If the route for a secure wireless transmission to the trackside device 1 is relatively long for the data packets or is impeded by the topography of the railway line, then the so-called multihop procedure may be used for wireless transmission as shown in FIG. 2.

A number of additional trackside devices with wheel sensors 21 and 22 and with assigned radio routers 23 and 24 are provided along the track 3 for this purpose. The radio routers 23 and 24 may be operated with an autonomous power supply, for example photovoltaically or via a voltage transformer. The current levels for the measured velocity value and for the further influencing variable 'acceleration' of the rail vehicle can be recorded at each location with the wheel sensors 21 and 22 and conveyed in wirelessly transferred data packets as a telegram.

The data packets or the telegram are received from the radio device 14 of the one trackside device 1, which is designed in this case as a signal box, and forwarded from there to the central train approach annunciator 13. The central train approach annunciator 13 is installed in the controller of the signal box and evaluates the transferred data packets or telegram. It outputs its outgoing information to a safeguarding device for the level crossing 7 via a relay interface which is normally already available.

The way in which the data packets or telegram are evaluated is described below in detail on the basis of FIG. 3, which shows that a telegram 30 arriving in the central train approach annunciator 13 is subjected to an evaluation 31. In a first readout stage 32 this telegram 30 is investigated to determine whether it originates from the further trackside device 2; a further readout stage 33 determines whether the telegram contains information about an approaching rail vehicle. If both of these are the case, then a signal S1 is output to the safeguarding device 34 for the level crossing 7. The arrival of the rail vehicle in the switch-on section 8 is thus recorded.

At the same time information about the measured velocity value vs of the rail vehicle over an evaluation stage 35 is forwarded to an input 36 of a train recognition device 37. The same applies for further information in the telegram that contains further influencing variables of the rail vehicle that determine the travel time, such as number of axles az and distance between axles aa. The further information likewise arrives at the train recognition device 37 via further inputs 38 and 39 from further evaluation stages 40 and 41. On the outgoing side the train recognition device 37 is connected to an adjustable timer 42, the output of which 43 is connected to a further input 44 of the safeguarding device 34.

If the arrival of a rail vehicle at the switch-on section 8 is indicated by the receipt of a signal S1 at the safeguarding device 34, then a fixed period that is sufficient for all safety requirements for timely closing of the level crossing 7 is predefined by the safeguarding device 34. In addition, a check on the transferred measured velocity value vs is started in order to determine whether a correction time is to be set, because the measured velocity value for example is comparatively low. If this is the case then a comparatively long correction time is set by means of the timer 42 and therefore the closure of the level crossing is delayed. A check on the set correction time is then immediately carried out, this being particularly dependent on further influencing variables that determine the travel time (in this case number of axles az and distance between axles aa). Thus with a high number of axles az and short distance between axles aa on a train moving relatively slowly, the rail vehicle type is concluded as being a freight train and therefore the correction time is unchanged or even extended. If the number of axles is low and the distance between axles is large, then the rail vehicle is a relatively fast-moving train of the passenger train type, and the correction time is reduced or eliminated completely. The safeguarding device 34 accordingly outputs status signals M at its output 45 to a railway safety system for closing the level crossing.

Of course, it is possible for the correction time to be set in a particularly systematic way by taking into account further influencing variables that determine the travel time, such as the length of the rail vehicle and its acceleration.

The same applies where further influencing variables that are specific to the type of rail vehicle, such as maximum speed and/or acceleration capability and/or motive force, are used in addition.

Figure 3:
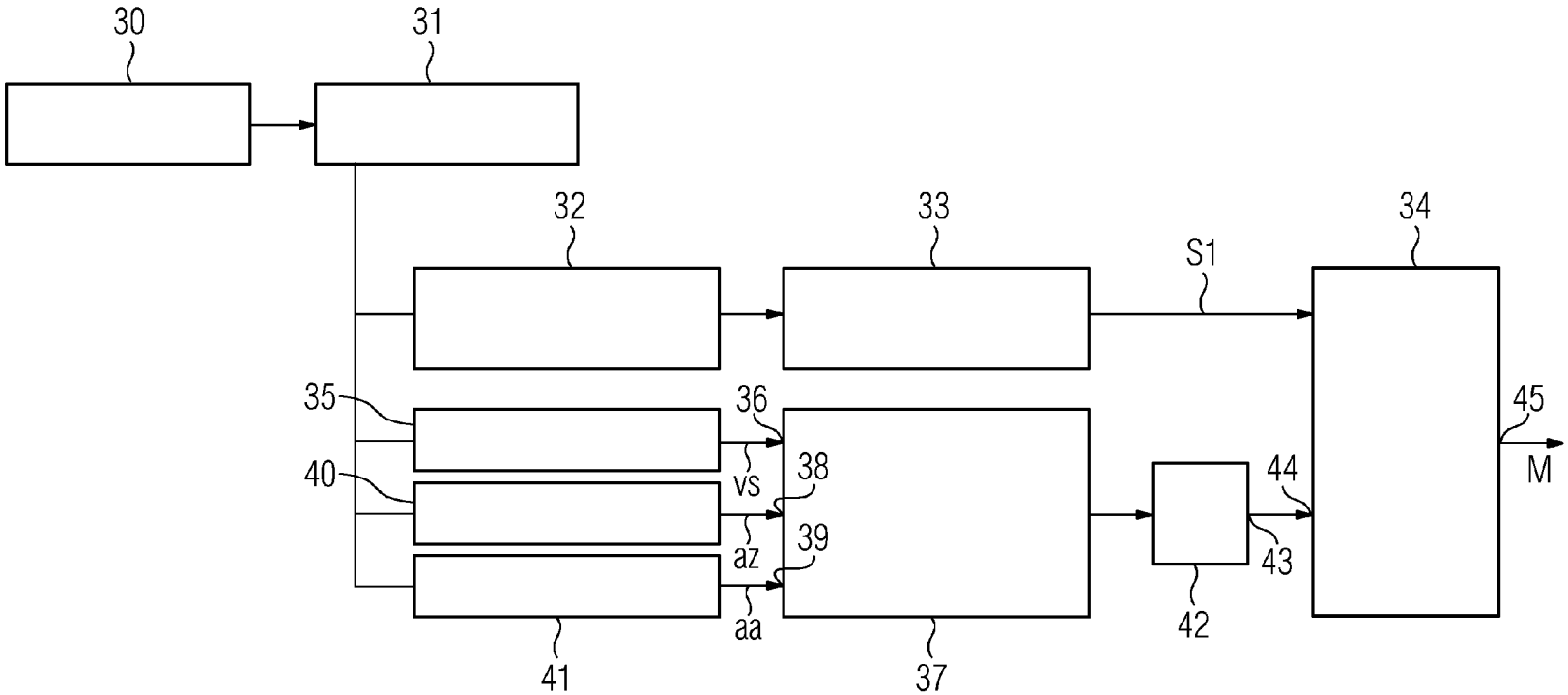
FIG. 3 is a further block diagram showing how the central train approach annunciator of the inventive railway safety system operates.

If the measured velocity value and possibly also the further influencing variable 'acceleration' is continuously or repeatedly recorded in places while the rail vehicle is traveling through the switch-on section 8, then the method is essentially the same as the process described on the basis of FIG. 3; the method merely works with particular accuracy.

Finally it should be noted that the further influencing variables that determine the travel time are taken into account with a suitable weighting.

The invention claimed is:

1. A method for operating a railway safety system having at least one trackside device while taking into account a measured velocity value recorded when a rail vehicle drives into a switch-on section of the railway safety system, which comprises the steps of:

predefining, by the at least one trackside device, a fixed period for forwarding a signal from the trackside device to an associated railway safety system;

using the measured velocity value measured when the rail vehicle drives into the switch-on section as a basis for checking whether a correction time to the fixed period is to be set according to the measured velocity value; and, when the correction time is to be set, adjusting the fixed period according to the correction time to obtain a corrected fixed period;

subsequently, checking the corrected fixed period to determine whether the set correction time should remain effective as a function of at least one further influencing variable of the rail vehicle that determines a travel time; and activating a safeguarding device for a level crossing.

2. The method according to claim 1, which further comprises using a recorded number of axles of the rail vehicle as the further influencing variable.

3. The method according to claim 1, which further comprises using a recorded distance between axles of the rail vehicles as the further influencing variable.

4. The method according to claim 1, which further comprises using a recorded length of the rail vehicle as the further influencing variable.

5. The method according to claim 1, which further comprises:

determining a rail vehicle type on a basis of the measured velocity value and the at least one further influencing variable; and using the rail vehicle type determined as a decision criterion for checking whether the set correction time remains effective.

6. The method according to claim 5, which further comprises using at least one of a number of axles, distance between axles, or a train length as further influencing variables for determining the rail vehicle type.

7. The method according to claim 1, which further comprises:

recording an acceleration of the rail vehicle when the rail vehicle drives into the switch-on section for obtaining the further influencing variable that determines the travel time; and taking into account the further influencing variable when setting and checking the corrected fixed period.

8. The method according to claim 7, which further comprises determining repeatedly the measured velocity value and the acceleration when the rail vehicle drives into the switch-on section.

9. The method according to claim 7, which further comprises determining repeatedly the measured velocity value and the acceleration when the rail vehicle travels through the switch-on section.

10. The method according to claim 8, which further comprises determining continuously the measured velocity values and the further influencing variable.

11. The method according to claim 7, which further comprises recording the velocity and the acceleration of the rail vehicle by means of a global positioning device or an odometer with a connected radio.

12. The method according to claim 11, which further comprises providing a global positioning system device as the global positioning device.

13. The method according to 11, wherein the radio corresponds to a global positioning system-railway standard or works with a transmission protocol as per IEEE 802.15.4 standard.

14. The method according to claim 1, which further comprises taking into account parameter data specific to a rail vehicle type as further influencing variables that determine the travel time.

15. The method according to claim 14, wherein at least one of a maximum speed specific to the rail vehicle type, an acceleration capability specific to the rail vehicle type, or a motive force are used as the parameter data specific to the rail vehicle type.

16. The method according to claim 15, which further comprises taking the parameter data specific to the rail vehicle type from an on-board computer of the rail vehicle.

17. The method according to claim 9, which further comprises recording the measured velocity value and the further influencing variable of the rail vehicle by means of a further trackside device provided on a drive-in end of the switch-on section.

18. The method according to claim 17, which further comprises providing a wheel sensor with a radio as the further trackside device.

19. The method according to claim 17, which further comprises:

providing an approach annunciator disposed beside a track with the radio as the further trackside device; and providing a central train approach annunciator as the trackside device.

20. The method according to claim 18, wherein the radio has a receiver for receiving parameter data specific to a rail vehicle type of the rail vehicle driving past, and a transmitter for transmitting the measured velocity value and the further influencing variable to the trackside device.

21. The method according to claim 17, wherein the measured velocity value and the acceleration are recorded and transferred to the trackside device by means of additional trackside devices having a radio module disposed along a track on the switch-on section of the railway safety system.

22. The method according to claim 21, which further comprises using radio routers in the further trackside devices.

23. The method according to claim 22, which further comprises using the radio routers with a receiver for parameter data specific to a rail vehicle type.

24. The method according to claim 1, wherein upon receipt of measured velocity values and transferred, further influencing variables recorded and transferred to the trackside device when the rail vehicle drives into the switch-on section and travels through the switch-on section, the corrected fixed period is calculated by weighting the individual variables and a timer is set accordingly.

25. The method according to claim 24, which further comprises using a counter as the timer, after expiration of the timer the signal is issued to the railway safety system.

26. A railway safety system, comprising:

a switch-on section having a drive-out end and a drive-in end;

a trackside device on said drive-out end of said switch-on section;

a further trackside device on said drive-in end of said switch-on section, said further trackside device equipped for recording a measured velocity value when a rail vehicle drives into said switch-on section; and said trackside device configured to perform the method of claim 1 and having a train detection device with inputs for recording the measured velocity value and further influencing variables that determine a travel time, and an adjustable timer being subordinated to said train detection device, said trackside device outputting a signal to an associated railway safety system being connected to said adjustable timer.

27. The railway safety system according to claim 26, wherein said adjustable timer is an electronic counter, after expiration of said adjustable time the signal is generated.

28. The railway safety system according to claim 26, wherein said further trackside device is a wheel sensor with a radio.

29. The railway safety system according to claim 26, wherein said further trackside device is an approach annunciator disposed beside a track with said radio and said trackside device is a central train approach annunciator.

30. The railway safety system according to claim 28, wherein said radio is configured such that said radio can transfer recorded measured velocity values and the further influencing variables wirelessly to said trackside device.

31. The railway safety system according to claim 28, wherein said radio is configured such that the further influencing variables showing parameter data specific to a rail vehicle type of a rail vehicle driving past can be recorded.

32. The railway safety system according to claim 28, wherein said radio has a receiver for receiving parameter data specific to a rail vehicle type of the rail vehicle driving past and a transmitter for transmitting measured velocity values recorded by said further trackside device and the further influencing variables to said trackside device.

33. The railway safety system according to claim 26, further comprising additional trackside devices having radio routers, from which additional measured velocity values are transferred to said trackside device, and said additional trackside devices are disposed along a track in said switch-on section.

34. The method of claim 1, wherein the at least one further influencing variable is transmitted by the train to the trackside device.

* * * * *